United States Patent [19]

Testa

[11] 4,167,349

[45] Sep. 11, 1979

[54] APPLICATOR FOR LIQUID COATING COMPOSITIONS

[76] Inventor: Dominick Testa, 29 Monaghan Rd., Edison, N.J. 08811

[21] Appl. No.: 907,799

[22] Filed: May 19, 1978

[51] Int. Cl.[2] ..... B05C 1/04; B05C 17/02

[52] U.S. Cl. ..... 401/144; 222/340; 222/385; 401/150; 401/177; 401/181; 417/555 R; 401/208

[58] Field of Search ..... 222/340, 384, 385; 401/15, 140, 141, 144, 150, 151, 176, 177, 179, 180, 181, 197, 203–206, 208, 282, 284; 417/555

[56] References Cited

U.S. PATENT DOCUMENTS

| | | | |
|---|---|---|---|
| 101,069 | 3/1870 | Wilder | 222/385 |
| 360,748 | 4/1887 | Wilkinson | 222/385 |
| 1,461,947 | 7/1923 | Sporer | 401/183 |
| 1,865,990 | 7/1932 | Wilcox | 222/385 |
| 2,086,467 | 7/1937 | Bryan | 222/385 |
| 2,528,657 | 11/1950 | Hobe | 91/62.5 |
| 2,772,031 | 11/1956 | Roselund | 222/385 |
| 2,882,542 | 4/1959 | Martin | 15/132.5 |
| 2,898,618 | 8/1959 | Whitfield | 15/128 |
| 2,928,113 | 3/1960 | Pedrow | 15/132.5 |
| 2,951,620 | 9/1960 | Sego | 222/385 |
| 3,036,327 | 5/1962 | Crawford | 401/15 |
| 3,070,825 | 1/1963 | Martin | 401/152 |
| 3,076,995 | 2/1963 | Rabelow | 15/562 |
| 3,082,469 | 3/1963 | Olson et al. | 401/15 |
| 3,124,080 | 3/1964 | Sisson | 222/385 |
| 3,195,170 | 7/1965 | Howard | 15/526 |
| 3,427,115 | 2/1969 | Jolly | 401/219 |
| 3,622,246 | 11/1971 | Grooms | 401/219 |
| 3,658,432 | 4/1972 | Lanusse | 401/219 |

FOREIGN PATENT DOCUMENTS

| | | | |
|---|---|---|---|
| 1189635 | 3/1959 | France | 401/197 |
| 868894 | 5/1961 | United Kingdom | 401/150 |

*Primary Examiner*—Clyde I. Coughenour
*Attorney, Agent, or Firm*—Ronald G. Goebel

[57] ABSTRACT

A device for the roller application of liquid coating compositions such as paint is provided comprising;

(a) a hollow body portion having an applicator opening at one end and a container opening at the opposite end; said portion containing;
  (1) a liquid feed tube extending from said applicator opening through said container opening;
  (2) a solid support member engaging the outside surface of said tube;
  (3) a rod reciprocatingly mounted in said solid support member and extending through the wall to the inside of said tube;
  (4) a flexible disc centrally mounted on said rod within said tube having a diameter substantially the same as the inside diameter of said tube;

(b) a hollow handle portion contiguous with said body portion having pivotably mounted therein a trigger, said trigger connected by linking means with said rod for reciprocating said rod within said tube;

(c) a container for said liquid coating composition mounted in said body portion at said container opening; said tube extending into said container; and (d) a roller applicator head section mounted on said hollow body portion at said applicator opening for rotatably retaining a roller, said head section comprising a longitudinal arched member having an aperture centrally located therein which communicates with said feed tube and a pair of triangular faced members extending perpendicularly downward from each edge of said arched member, each face member containing means for retaining a roller therebetween.

21 Claims, 6 Drawing Figures

APPLICATOR FOR LIQUID COATING COMPOSITIONS

BACKGROUND OF THE INVENTION

This invention relates to a hand held device for the roller application of liquid coating compositions such as paint which employs a hand pumping mechanism operable from a handle section in the device to allow efficient and controlled distribution of coating on a roller.

The roller application of coating compositions such as paints to surfaces has achieved widespread use along with other applicator techniques such as brushing and spraying. In general, the paint roller consists of a handle and a wool or mohair covered cylinder rotatably mounted on the handle. Paint is first applied to the roller by emersing the roller in a shallow tray containing the paint and rolling excess paint off on a flat, grated section of the roller tray. The paint is then applied to the surface to be covered by manually rolling the roller over the surface. When the roller no longer yields a sufficient supply of paint to the surface, the process is repeated.

Inherent in this procedure is the inconvenience and loss of time involved in loading the roller with paint from the tray at regular intervals during painting beside the added loss of time in periodically refilling the tray. To solve this problem, there have been developed a number of hand-held roller devices which carry a reservoir of paint on or near the device itself and which employ appropriate means to control flow and distribution of the paint on the roller.

In U.S. Pat. No. 2,882,542 to W. W. Martin, for example a roller-type paint applicator is described comprising a roller, a paint distributor tube mounted over the roller having spaced holes through which paint is discharged onto the roller surface, and a reservoir bulb forming a hand grip which contains and supplies paint to the paint distributor tube via a hollow stem. As paint is needed on the roller, the painter squeezes the bulb, forcing paint to the distributor tube and outwardly through the holes onto the surface of the roller as the roller is rotated on the surface being painted.

In U.S. Pat. No. 2,898,618 to W. A. Whitfield and J. Weber Jr., a hand-held cylindrical roller applicator for applying paint products is described comprising a cylindrical roller, a material distribution hood and chamber having a concave curved bottom which loosely engages and conforms to the curvature of the roller and having a plurality of spaced passageways for receiving and distributing paint on the roller; a handle, and a paint supply under pressure which communicates with the material distribution hood and whose flow is regulated by valve means in the handle.

In U.S. Pat. No. 2,528,657 to E. T. Hobe, a paint applicator is provided comprising an elongated housing having a handle, an upper coating fluid reservoir and a lower roller chamber containing a pair of rollers, one being an applicator roller and the other a corrugated feed roller. A fluid trough in the roller chamber projects into the space between the rollers and has openings through which fluid can pass to the rollers. A spring loaded valve in the housing opens and closes a valve seat opening which communicates fluid from the fluid reservoir to the trough. The valve comprises a stem projecting outwardly from the housing, and a lever pivotably connected to the stem and pivotably mounted on the handle for opening the valve.

In U.S. Pat. No. 3,622,246 to W. W. Grooms, a gravity fed painting device is described comprising a functionally-shaped reservoir provided with an aperture, a paint dispensing roller operably mounted on the reservoir near the aperture, wiper blades mounted on the reservoir and a handle for holding the device. Other fluid applicators and paint rollers are described in U.S. Pat. Nos. 3,427,115, 3,195,170, 3,076,995 and 2,928,113.

The present invention provides a novel hand-held device for rolling liquid coating compositions containing a hand-pumping mechanism activated in the handle portion thereof which allows the user to effectively control the amount of coating composition distributed to the roller. The device is particularly useful for paint applications but may also be used for applying any type of liquid coating compositions such as inks, liquid polymer compositions, stains, waxes, glues and the like. In contrast to the above mentioned patents, the present invention contains no reservoir bulbs; does not employ a plurality of spaced passageways to distribute paint on a roller or a pressurized source of coating composition; does not require feed rollers and does not employ a gravity feed to distribute the coating composition.

SUMMARY OF THE INVENTION

The present liquid coating composition applicator comprises, a hollow body portion having an applicator opening at one end and a container opening at the opposite end. An internally threaded cap is located at the applicator opening and removably engages a roller head section having an externally threaded neck portion on the head section. The roller head section consists of a longitudinal arched member having a contour substantially the same as a roller and a pair of triangular faced members extending perpendicularly downward from the arched member having means for rotatably engaging a cylindrical roller fitted on each end with hub plugs. Centrally located on the arched member within the neck portion is an oblong aperture which allows coating composition to reach the roller.

A threaded cap containing a seal is mounted on the container opening and engages an externally threaded neck portion of a container for the liquid coating composition. The seal prevents coating composition from entering the hollow body portion.

A hollow rigid feed tube made of a material such as molded plastic and flared at one end to an oblong shape extends from the oblong aperture in the head section through the applicator opening and body portion, through a central opening in the container cap and seal, partially into the container. A section of flexible tubing is mounted on the end of the feed tube and extends downwardly into the container. The feed tube and extension together define a pathway for the coating composition in the container to reach the roller.

A hollow handle portion located above the hollow body portion allows the device to be hand-held and contains a trigger which through appropriate linkages activates a reciprocating pump mechanism located in the body portion for moving fluid from the container to the roller through the tubes.

The pump mechanism consists of a thin rod having a flexible disc mounted thereon axially disposed inside a section of tubing in the body portion, the disc having a diameter substantially the same as the inside diameter of the tube. The opposite end of the rod extends outside the tube through a solid section engaging the upper surface of the tube and is pivotably connected to the lower end of a lever arm pivotably mounted in the body portion. The upper end of this arm is pivotably mounted on a vertical bar which extends from a upwardly-tensioned spring mounted in the handle portion. The trigger is pivotably connected to the bar and is pivotably mounted in the handle portion.

By alternately squeezing and releasing the trigger, the user causes the rod, through the linkage mentioned above, to reciprocate within the tube. When the rod moves toward the container, the disc encounters fluid pressure and in response thereto distorts so that coating composition flows around the periphery of the disc to the opposite side thereof i.e. the intake step. When the rod is caused to move toward the head section, the disc straightens out sealing the tube and moving fluid entrapped by the intake step toward the applicator opening i.e. the discharge step.

The head section of the device can be designed to fit any size cylindrical roller and even corner rollers having a cylindrical inner core. The device may be made more efficient by installing a swing-check valve upstream from the disc to increase the fluid pressure encountered by the disc during the intake step.

By operating the trigger or, if necessary, not operating the trigger, a controlled amount of coating composition can be supplied to the roller thus allowing continuous use of the device while preventing too much or too little coating composition from reaching the roller.

DETAILED DESCRIPTION OF THE PREFERRED EMBODIMENTS

Figure 1:
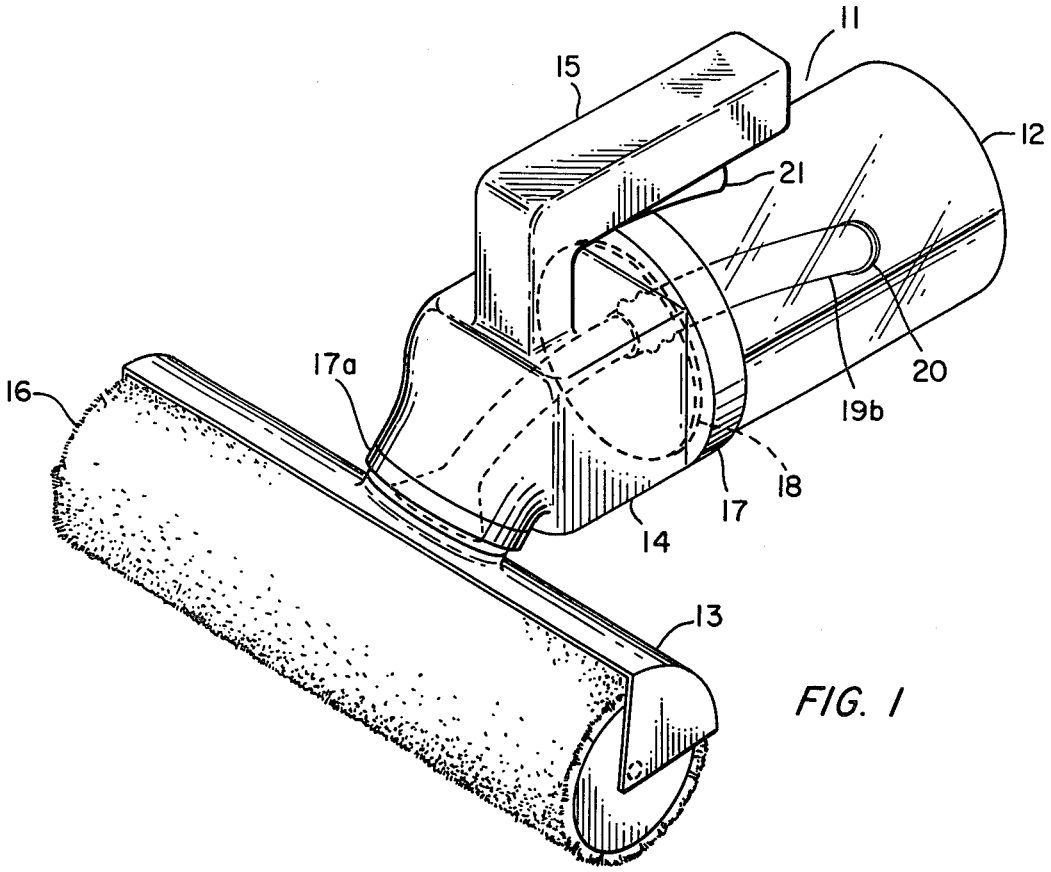
FIG. 1 is a perspective view of the applicator of this invention.

FIG. 1 shows a perspective view of the preferred liquid coating composition applicator of this invention. The applicator, shown generally by 11, consists of a container section 12, a roller head section 13, hollow body portion 14, a hollow handle portion 15 which is contiguous with said body portion 14 and a roller applicator 16 such as a mohair or wool cylindrical roller rotatably mounted in head section 13. The roller head section 13, hollow body portion 14 and hollow handle portion 15 are made of a material such as thin metal or plastic. Container 12 is preferably a clear glass or plastic jar having external threads on its open end which are threaded into internal threads on circular cap 17 mounted on the rearward end of body portion 14. The cap 17 is also fitted with a thin circular seal 18 to prevent liquid in the container 12 from entering body portion 14. The forward end of body portion 14 is also equipped with a circular cap **17*a* having internal threads and a centrally located circular aperture. The head section 13 has an externally threaded neck which is threaded into the cap 17*a* to secure the head section to the body portion 14**. (See FIGS. 2 and 4)

A flexible feed tube **19*a* comprised of a material such as flexible polyethylene lies within the container and is connected with a rigid tube that extends through the hollow body portion to an aperture in the head section 13 (not shown). Strainer 20 on the end of tube 19*b*** filters out solid or agglomerated particles in the coating composition.

A trigger or hand activator 21 pivotably mounted within the hollow handle section 15 operates a pump mechanism within the body portion 14 to draw paint from the container 12 through the tubes to the roller 16. This pump mechanism will be shown in more detail in connection with FIG. 2 below.

Figure 2:
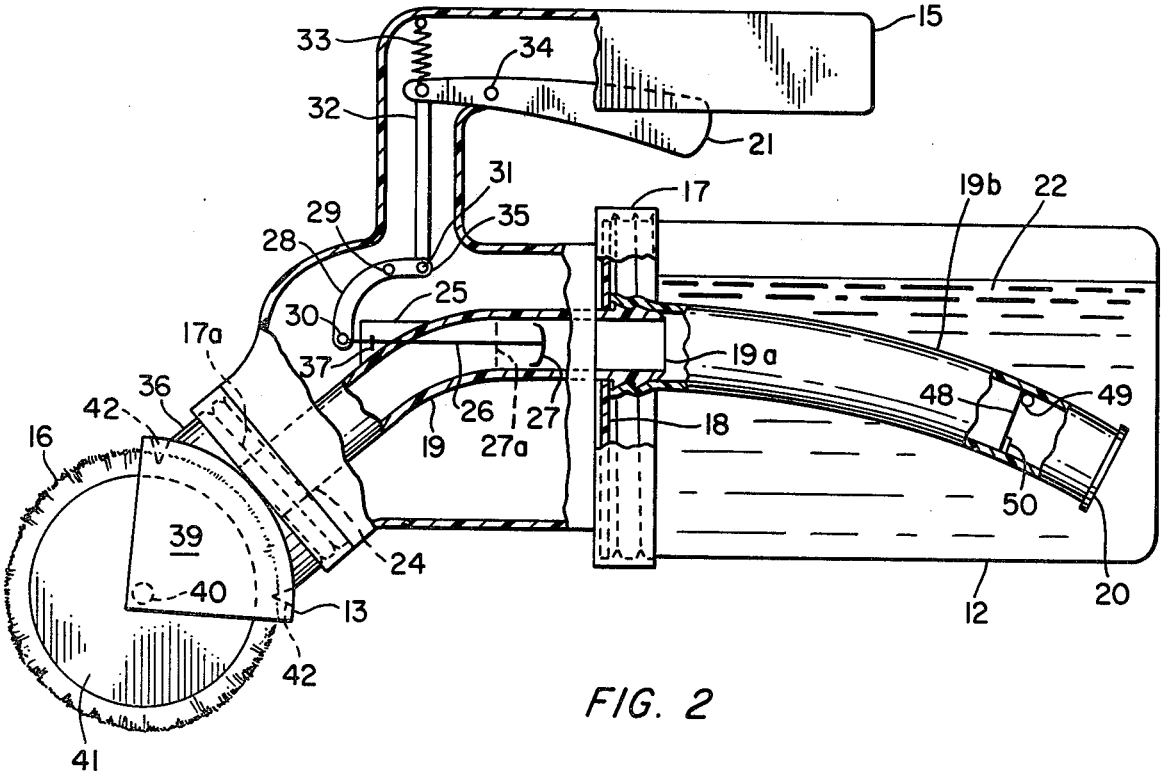
FIG. 2 is a side view of the applicator of FIG. 1 also showing a section through the hollow handle portion and body portion.
Figure 3:
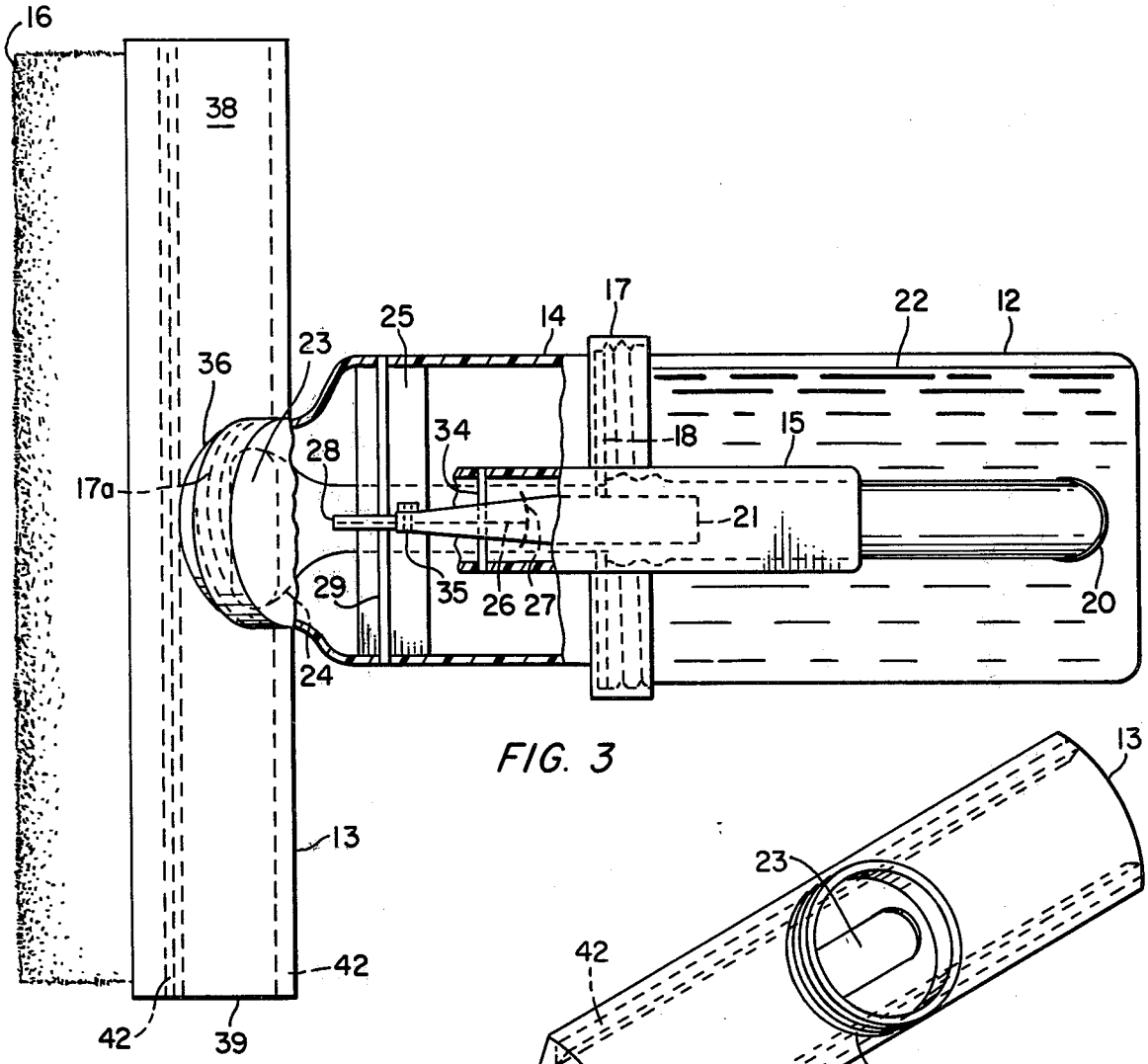
FIG. 3 is a top view of FIG. 2.

FIG. 2 is a side view of the applicator of FIG. 1 also showing a section through hollow body portion 14 and handle portion 15. FIG. 3 shows a top view of the applicator or FIG. 2.

As shown in FIGS. 2 and 3, rigid tube 19 comprised of a material such as molded plastic extends from oblong aperture 23 centrally located in longitudinal section 30 of head section 13 through central aperture in cap **17*a*, through hollow body portion 14, centrally through cap 17 and seal 18 and partially into container 12. The discharge end 24 of tube 19 flares outwardly to an oblong shape to conform to and align with the oblong shape of aperture 23. The container end 19*a* of tube 19 is in the form of a stepped grooved fitting. Force fitted into grooved end 19*a* is flexible tubing extension 19*b* which falls downwardly into container 12. The end of flexible tubing 19*b* is equipped with strainer 20 to filter out solid or agglomerated particles in the coating composition 22** in the container.

it is also within the scope of this invention to have tube 19 extend all the way into container 12 instead of using flexible tube **19*b*** as an extension thereof.

Mounted between the sides of hollow body portion 14 and engaging a portion of the upper outer surface of tube 19 is solid support member 25. Slidably mounted in support member 25 is horizontal rod 26 which can be made of thin steel wire or the like. One end of the rod 26 extends through the tube wall and along the inside axis of the tube. At the end of the rod is mounted a flexible disc 27 made of a material such as flexible rubber, plastic or metal having a diameter substantially the same as the inside diameter of the tube 19. The opposite end of the rod 26 extends outside support member 25 and is pivotably connected to the lower end 30 of lever arm 28 by means of a cotter pin, axial pin or other connector which allows a slight rotation at the point of connection. A seal 37 is located within the member 35 through which rod 26 passes to prevent liquid in the tube from seeping along the rod into the body portion. Lever arm 28 is pivotably mounted within body portion 14 by means of pivot pin 29 which extends between the sides of the body portion. The upper end 31 of lever arm 28 is pivotably connected to vertical bar 32 at 35. The bar 32 extends from spring 33 mounted at the top of handle portion 15. Pivotably connected to bar 32 just below spring 33 is trigger member 21. The trigger member 21 is pivotably mounted within the hollow handle portion 15 by means of pivot pin 34 which extends between the sides of handle portion 15.

The head section 13 of the applicator is used to retain the roller 16 and to prevent coating composition from splashing on the user. The head section 13 consists of a longitudinal arched section 38 having a curvature substantially the same as roller applicator 16 and a length slightly larger than the length of a roller applicator e.g. 9¼ inches for a 9 inch roller. A previously mentioned, the head section has an oblong aperture 23 centrally located thereon to permit liquid to reach roller 16. At each end of the arched section is a triangular face 39 which extends downward and perpendicularly from each edge to a point substantially equal to the radius of the roller.

The central portion of arched member 38 contains externally threaded neck portion 36 which is threaded into the internal threads of cap 17*a* to form a tight fit therewith as previously mentioned. When completely threaded, the oblong aperture 23 in the head section lines up with and receives in close fit the flared oblong end 24 of tubing 19.

At the apex of each triangular face 39 on the inside surface thereof is hemispherical protrusion 40 which engages a recess 44 in the center of hub plug 41 fitted on each end of roller 16. This is shown in more detail in FIG. 5. Along the underside of each longitudinal edge of arched member 38 are a pair of wipers 42 of triangular cross section which engage the surface of roller 16 and act to wipe excess coating composition off the roller during application.

Operation of the hand pumping mechanism can be understood with reference to FIG. 2. As shown in the Figure, the elements of the mechanism are in the positions for the first or intake stroke of the pumping cycle such as when no hand pressure is exerted upwardly on trigger 21. The tension in spring 33 acting upwardly causes trigger 21 to move downwardly on pivot pin 34. At the same time vertical bar 32 moves upwardly and causes lever arm 28 to pivot counter-clock wise on pin 29. This inturn causes rod 26 to move rightward toward the intake end of the tube 19. In doing so the flexible disc 27 encounters pressure from liquid in the tube and in response thereto its periphery curves inwardly as shown in the Figure. Liquid under pressure on the intake side of the tube 19 then flows around the periphery of the disc to the opposite side thereof, i.e., the discharge side.

When the user presses the trigger 21 upwardly, the discharge cycle begins. In response thereto, the vertical bar 32 moves downwardly and causes lever arm 28 to pivot clockwise about pin 29. The rod then moves leftward through section 25 causing the disc 27 to straighten as shown by the dotted lines 27*a* and pulling along with it liquid on the discharge side of the tube 19 from the first stroke. The liquid then flows downwardly to aperture 23 where it contacts roller 16 via aperture 23. Thus by alternately pulling and releasing the trigger upwardly and downwardly the disc 27 acts as a pump moving fluid along tube 19. In order to make the pumping action more efficient, it is preferred to equip the tube 19*b* with swing check valve 48 located near the intake end of the tube as shown in the sectioned portion of tube 19*b* in FIG. 2. The valve is hinged in the wall of the tube at 49 and contains stop 50 on the intake side of the valve. By using such swing check valve the disc 27 will encounter increased fluid pressure during the intake step, causing the periphery to distort more thereby allowing greater liquid flow around the disc. During the discharge step, swing check valve 48 opens, admitting liquid to tube 19.

Figure 4:
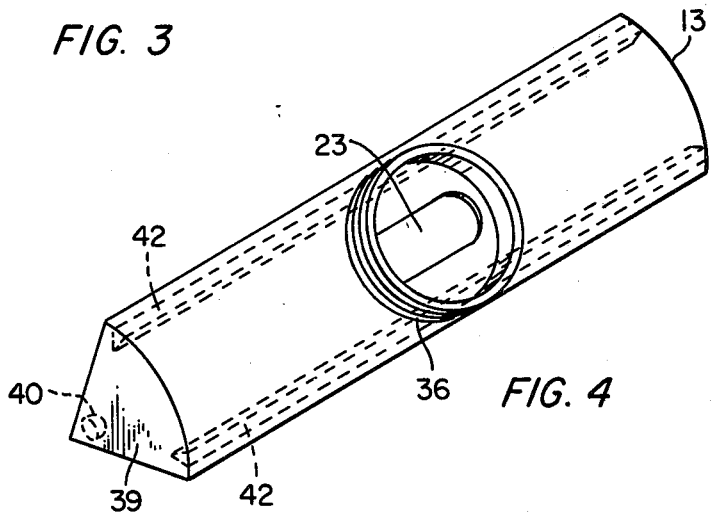
FIG. 4 is a perspective view of the head section of FIG. 1, 2 and 3.

FIG. 4 is a perspective view of the head section 13 showing further the externally threaded neck portion 36 and oblong aperture 23.

Figure 5:
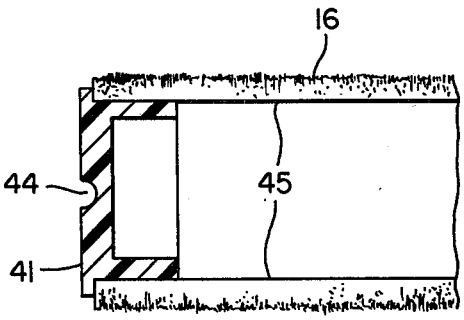
FIG. 5 is a side view of a cylindrical roller containing a hub plug adapter for rotatably engaging the head section of the applicator.

FIG. 5 shows a side view of a section of a roller applicator. The roller applicator consists of an absorbent surface such as wool or mohair mounted on a solid metal or plastic cylinder 45. The circular plug 41 having circular recess 44 is press-fitted on each end of the roller where it engages the inside surface of cylinder 45. The internal hemispherical protrusion 40 on triangular face 39 of head section 13 fits into recess 44 to allow rotational movement of the roller.

The head section containing neck portion 36 and aperture 23 may be altered to fit any size roller and any shape roller.

Figure 6:
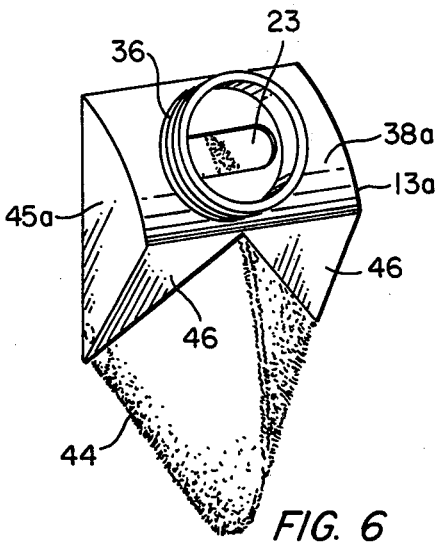
FIG. 6 is a perspective view of a head section rotatably engaging a corner roller.

FIG. 6 shows a perspective view of a head section 13*a* for rotatably retaining a corner roller 44 which is in the shape of a discus. Triangular faces 45*a* are made longer than for a cylindrical roller to accommodate the large radius of the corner roller, and longitudinal arched member 38*a* is made shorter to accommodate the shorter width of the corner roller. A pair of triangular plates 46 extend downwardly from each side of member 38*a* and engage the surface of corner roller 44 to prevent splashing of coating composition and to confine coating composition from oblong aperture 23 to the surface of the roller.

I claim:

1. A device for distributing liquid coating composition on a roller comprising;

(a) a hollow body portion having an applicator opening at one end and a container opening at the opposite end; said portion containing;
  (1) a liquid feed tube extending from said applicator opening through said container opening;
  (2) a solid support member engaging a portion of the outside surface of said tube;
  (3) a rod reciprocatingly mounted in said solid support member and extending through the wall of said tube and along the inside axis of said tube;
  (4) a flexible disc centrally mounted on said rod within said tube having a diameter substantially the same as the inside diameter of said tube;

(b) a hollow handle portion contiguous with said body portion having pivotably mounted therein a trigger, said trigger connected by linking means with said rod for reciprocating said rod within said tube;

(c) a container for said liquid coating composition mounted on said body portion at said container opening; said tube extending into said container; and (d) a roller applicator head section mounted on said hollow body portion at said applicator opening for rotatably retaining a roller, said head section comprising a longitudinal arched member having an aperture centrally located therein which communicates with said feed tube and a pair of triangular-faced members extending perpendicularly downward from each edge of said arched member, each face member containing means for retaining a roller therebetween.

2. The device of claim 1 wherein said feed tube is flared outwardly to an oblong shape at said applicator opening.

3. The device of claim 2 wherein said aperture in said head section has an oblong shape, said aperture communicating with said oblong feed tube at said applicator opening.

4. The device of claim 1 wherein said solid support member contains a seal for said rod to prevent coating composition from passing from said tube to said body portion.

5. The device of claim 1 wherein said linking means comprises;

(a) a spring mounted at the top of said handle portion;
(b) a vertical bar mounted on said spring and pivotably connected with said trigger;
(c) a lever arm pivotably mounted in said hollow body portion and pivotably connected at the upper end to said vertical bar and at the lower end to said rod.

6. The device of claim 1 wherein said tube contains a swing-check valve between said disc and the end of said tube extending into said container.

7. The device of claim 1 wherein a strainer is mounted on the end of said tube extending into said container.

8. The device of claim 1 wherein said body portion is equipped with an internally threaded container cap overlying said container opening and said container has an externally threaded neck portion which engages said cap in close fit.

9. The device of claim 1 wherein said body portion is equipped with an internally threaded head cap overlying said applicator opening and said arched member has an externally threaded circular neck overlying said aperture, said neck engaging said cap in close fit.

10. A liquid coating composition applicator comprising;

(a) a unitary hollow body and handle section having an applicator opening at one end and an internally threaded circular cap overlying said applicator opening, and having a container opening at the opposite end and an internally threaded circular cap and seal overlying said container opening, said section further containing;
(1) a rigid feed tube extending from said applicator opening through said container cap and seal, the end of said tube extending from said applicator opening being oblong in shape;
(2) a solid support member engaging the outside surface of said tube;
(3) a rod reciprocatingly mounted in said solid support member and extending through the wall to the inside of said tube;
(4) a flexible disc centrally mounted on said rod within said tube having a diameter substantially the same as the inside diameter of said tube;
(5) a lever arm pivotably mounted in said section, said rod pivotably connected to the lower end of said arm;
(6) a vertical bar extending from a spring means mounted in said handle and pivotably connected with the upper end of said lever arm; and
(7) trigger means pivotably mounted in said handle connected with said bar.
(b) a container for said liquid coating composition having an externally threaded neck removably mounted on said container cap;
(c) a flexible feed tube connected with said rigid tube extending into said container;
(d) a roller applicator head section comprising;
(1) a longitudinal arched member having an oblong aperture centrally located therein;
(2) a circular externally threaded neck portion overlying said oblong aperture and removably mounted on said applicator cap; said aperture communicating with said oblong end of said tubing;
(3) a pair of triangular-faced members extending perpendicularly downward from each edge of said arched member; and
(4) a hemispherical projection located on the inside surface of each triangular-faced member; and
(e) a roller adapted to spread a coating composition comprising an outer surface of absorbent material, a hollow inner cylindrical support for said material and a pair of circular hub plugs fitted into each end of said cylindrical support, each hub plug having a centrally located circular recess which rotatably engages a hemispherical projection.

11. The applicator of claim 10 wherein said arched member further comprises a pair of longitudinal wipers disposed on the inside surface of said arched member which engage said absorbent material.

12. The applicator of claim 10 wherein said flexible tube further comprises a swing check valve located between said disc and the end of said tube extending into said container.

13. The applicator of claim 10 wherein a strainer is mounted on the end of said flexible tube extending into said container.

14. A device for hand pumping a liquid comprising:

(a) a hollow body portion having a distribution opening at one end and a container opening at the opposite end; said portion containing;
(1) a liquid feed tube extending from said applicator opening through said container opening;
(2) a solid support member mounted in said portion engaging a portion of the outside surface of said tube;
(3) a rod reciprocatingly mounted in said solid support member and extending through the wall of said tube and along the inside axis of said tube;
(4) a flexible disc centrally mounted on said rod with in said tube having a diameter substantially the same as the inside diameter of said tube; and
(b) a hollow handle portion contiguous with said body portion having pivotably mounted therein a trigger, said trigger connected by linking means with said rod for reciprocating said rod within said tube.

15. The device of claim 14 wherein said solid support member contains a seal for said rod to prevent coating composition from passing from said tube to said body portion.

16. The device of claim 14 wherein said linking means comprises;

(a) a spring mounted at the top of said handle portion;
(b) a vertical bar mounted on said spring and pivotably connected with said trigger;
(c) a lever arm pivotably mounted in said hollow body portion and pivotably connected at the upper end to said vertical bar and at the lower end to said rod.

17. The device of claim 14 wherein said tube contains a swing-check valve between said disc and the end of said tube extending through said container opening.

18. The device of claim 14 wherein a strainer is mounted on the end of said tube extending through said container opening.

19. A device for hand-pumping a liquid coating composition comprising a unitary hollow body and handle section having a distribution opening at one end and a container opening at the opposite end, said section further containing;

(1) a liquid feed tube extending from said distribution opening through said container opening;
(2) a solid support member mounted in said section engaging a portion of the outside surface of said tube;

(3) a rod reciprocatingly mounted in said solid support member and extending through the wall of said tube and along the inside axis of said tube;

(4) a flexible disc centrally mounted on said rod within said tube having a diameter substantially the same as the inside diameter of said tube;

(5) a lever arm pivotably mounted in said section, said rod pivotably connected to the lower end of said arm;

(6) a vertical bar extending from a spring means mounted in said handle and pivotably connected with the upper end of said lever arm; and (7) trigger means pivotably mounted in said handle connected with said bar.

20. The device of claim 19 wherein said tube further comprises a swing check valve located between said disc and the end of said tube extending into said container.

21. The device of claim 19 wherein a strainer is mounted on the end of said tube extending through said container opening.

* * * * *